US005826750A

United States Patent [19]

Johnson

[11] Patent Number: 5,826,750

[45] Date of Patent: Oct. 27, 1998

[54] TOY WATER GUN WITH FLUID SELECTION CONTROL VALVE

[75] Inventor: Lonnie G. Johnson, Smyrna, Ga.

[73] Assignee: Johnson Research & Development Corporation, Inc., Atlanta, Ga.

[21] Appl. No.: 780,627

[22] Filed: Jan. 8, 1997

[51] Int. Cl.[6] ..... A63H 3/18

[52] U.S. Cl. ..... 222/79; 222/401; 446/473

[58] Field of Search ..... 222/79, 325, 401, 222/400.8, 396; 446/473

[56] References Cited

U.S. PATENT DOCUMENTS

| | | | |
|---|---|---|---|
| D. 78,206 | 4/1929 | Hermann . | |
| D. 159,040 | 7/1950 | Bicos | D30/1 |
| D. 265,221 | 6/1982 | Hardin | D21/147 |
| D. 285,327 | 8/1986 | Yano | D21/147 |
| D. 297,748 | 9/1988 | Marino | D21/147 |
| D. 303,820 | 10/1989 | Wong | D21/147 |
| D. 318,309 | 7/1991 | D'Andrade | D21/147 |
| D. 336,939 | 6/1993 | Salmon et al. | D21/147 |
| D. 338,697 | 8/1993 | Salmon et al. | D21/147 |
| D. 340,750 | 10/1993 | Salmon et al. | D21/147 |
| D. 341,174 | 11/1993 | Salmon et al. | D21/147 |
| 1,964,345 | 7/1934 | Feller . | |
| 2,049,194 | 7/1936 | Chapin | 43/147 |
| 2,303,510 | 12/1942 | Swebilius | 42/69 |
| 3,197,070 | 7/1965 | Pearl | 222/79 |
| 3,273,553 | 9/1966 | Doyle | 124/3 |
| 3,794,789 | 2/1974 | Bynum | 200/83 Z |
| 4,022,350 | 5/1977 | Amron | 222/790 |
| 4,160,513 | 7/1979 | Cockerman | 222/181 |
| 4,214,674 | 7/1980 | Jones et al. | 222/79 |
| 4,441,629 | 4/1984 | Mackal | 222/324 |
| 4,509,659 | 4/1985 | Cloutier et al. | 222/41 |
| 4,591,071 | 5/1986 | Johnson | 222/39 |
| 4,706,848 | 11/1987 | D'Andrade | 222/79 |
| 4,743,030 | 5/1988 | Auer et al. | 273/349 |
| 4,750,641 | 6/1988 | Hun | 222/798 |
| 4,757,946 | 7/1988 | Johnson | 239/99 |
| 4,875,508 | 10/1989 | Burke et al. | 141/2 |
| 4,955,512 | 9/1990 | Sharples | 222/386.5 |
| 5,029,732 | 7/1991 | Wong | 222/79 |
| 5,074,437 | 12/1991 | D'Andrade | 222/79 |
| 5,150,819 | 9/1992 | Johnson et al. | 222/79 |
| 5,155,310 | 10/1992 | Goans | 200/82 |
| 5,184,755 | 2/1993 | Brovelli | 222/79 |
| 5,184,756 | 2/1993 | Amron | 222/79 |
| 5,229,531 | 7/1993 | Song | 42/58 |
| 5,238,149 | 8/1993 | Johnson et al. | 222/79 |
| 5,244,153 | 9/1993 | Kuhn et al. | 239/587.5 |
| 5,305,919 | 4/1994 | Johnson et al. | 222/401 |
| 5,322,191 | 6/1994 | Johnson et al. | 222/401 |
| 5,339,987 | 8/1994 | D'Andrade | 222/79 |
| 5,360,142 | 11/1994 | Stern et al. | 222/79 |

*Primary Examiner*—Philippe Derakshani
*Attorney, Agent, or Firm*—Kennedy, Davis & Kennedy

[57] ABSTRACT

A water gun (10) is provided having a storage tank (18), a pressure tank (19), a pump (32) for conveying liquid from the storage tank to the pressure tank, and a control valve (39) which determines whether water or air is to be drawn by the pump and deposited within the pressure tank. The pressurized liquid is released through a nozzle (21) coupled to the pressure tank by actuation of a trigger (17).

20 Claims, 3 Drawing Sheets

TOY WATER GUN WITH FLUID SELECTION CONTROL VALVE

TECHNICAL FIELD

This invention relates to toy water guns, and specifically to water guns using compressed air to expel water therefrom.

BACKGROUND OF THE INVENTION

Water guns which eject a stream of water have been a very popular toy for children. These guns have been designed to eject the stream of water in a number of ways. The most common method of ejecting water has been by a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which create single, short bursts of water. However, many children desire the production of an extended stream of water.

Water guns have also been designed with small electric pumps which expel a stream of water from a tube coupled to the pump, as shown in U.S. Pat. Nos. 4,706,848 and 4,743,030. However, these small electric pumps typically do not generate enough force to eject the stream of water a lengthy distance.

Toy water guns have also been developed which eject a stream of water by exerting pressure on the water within the gun greater than that of ambience and controlling the release of water through a control valve. The water is expelled from the gun due to this pressure difference. The pressurization of the water has been achieved in a variety of manners. U.S. Pat. No. 3,197,070 illustrates a water gun wherein pressure is applied to the water by collapsing a water storage area. Similarly, U.S. Pat. No. 4,854,480 illustrates a water gun wherein water is forced into an elastic bladder which expands to maintain the water under pressure. The presence of air within the storage area is a problem, as a portion of the elastic force of the bladder inherently is used to compress the air rather than pressurizing the water. This use of the elastic force of the bladder is inefficient.

Lastly, water guns have been designed with manual pumps which force water from a storage reservoir to a pressure reservoir, as shown in U.S. Pat. No. 5,150,819. The conveyance of the water into the pressure tank compresses the air therein, thereby exerting pressure on the water within the storage tank. However, as water is released from the pressure tank the volume occupied by the air increases. This increase in air space volume causes the air pressure within the pressure tank to decrease rapidly, thus resulting in a decrease in water pressure and a weaker projected water stream.

Accordingly, it is seen that a need remains for a water gun which can generate a long, steady stream of water in an efficient manner. It is to the provision of such therefore that the present invention is primarily directed.

SUMMARY OF THE INVENTION

In a preferred form of the invention a water gun comprises a storage reservoir adapted to hold liquid, a pressure tank adapted to hold liquid, a pump adapted to pump liquids or gases, conduit means for conveying liquid from the storage reservoir to the pump. The water gun also has control valve means having an air intake, the control valve means selectively controls the introduction of air through the air intake and into the pressure tank through the actuation of the pump or the introduction of liquid from the storage reservoir into the pressure tank through the actuation of the pump.

DETAILED DESCRIPTION

Figure 1:
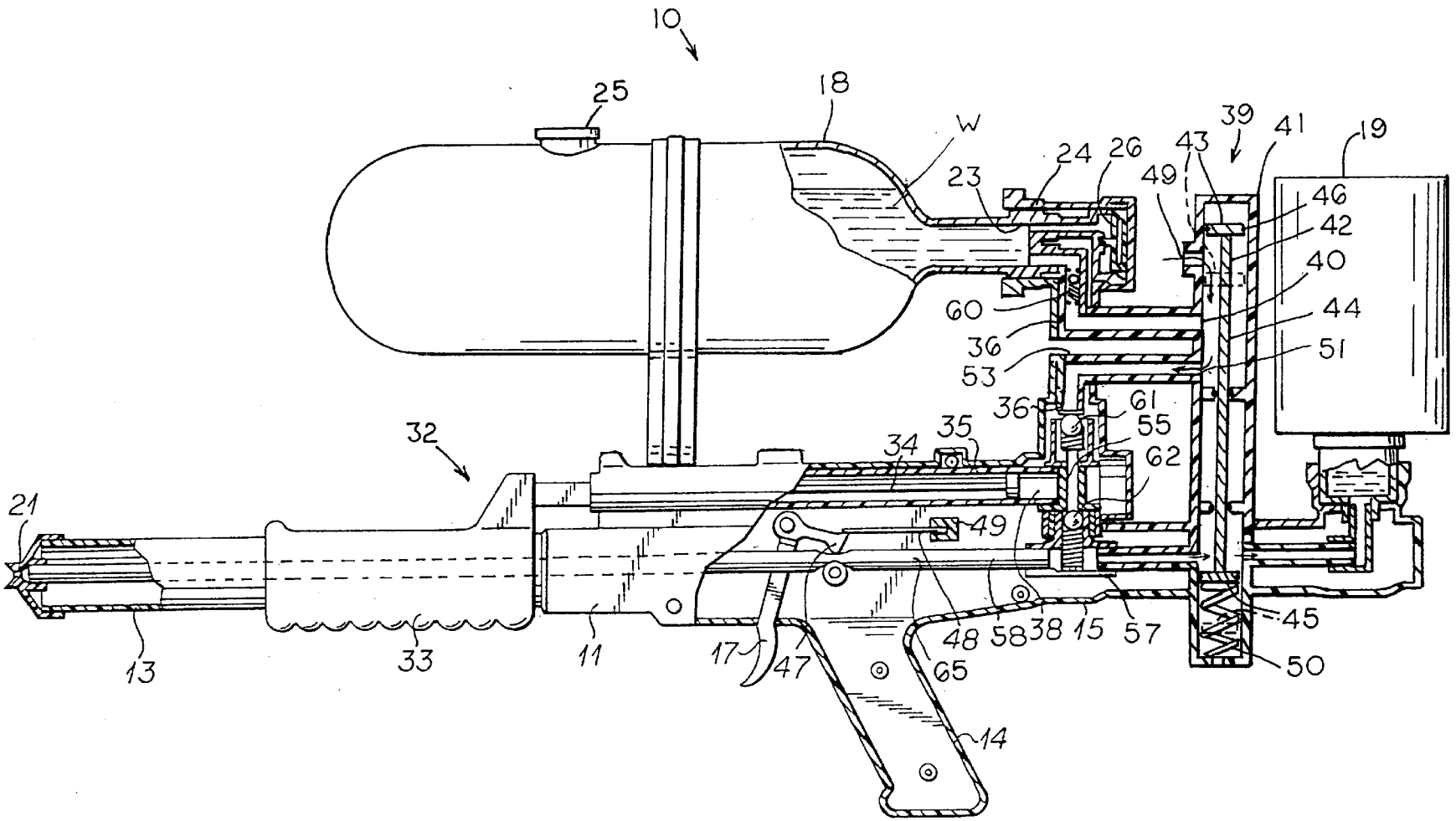
FIG. 1 is a side view of a water gun embodying principles of the invention is a preferred form, shown in partial cross-section with air being forced into the pressure tank.

With reference next to the drawings, there is shown a water gun 10 having a housing 11 in the shape of a gun with a barrel 13, a handle 14 and a stock 15. The gun 10 has a trigger 17, a removable liquid storage tank or reservoir 18 coupled to the stock 15, a liquid pressure reservoir or tank 19 mounted to the stock, and a conventional nozzle 21 mounted to the end of the barrel 13. The storage tank 18 has a threaded neck 23 threadably mounted within a threaded receptor 24 within the housing and an opening or port 22 in which is removably mounted a filling cap 25. The receptor 24 has a spring biased check valve or vent 26 which allows air to enter storage tank 18.

The gun 10 has a pump 32 having a handle 33 slidably mounted to barrel 13. The handle 33 is coupled to a piston 34 slidably mounted within a cylinder 35. The cylinder 35 and piston 34 define a chamber 38. An intake tube 36 extends from storage tank 18 to an opening 40 within a pressure sensitive control valve 39.

The pressure sensitive control valve 39 has a cylindrical manifold 41 and a piston 42 mounted within the manifold 41 for movement between an air pressurizing position and a water pressurizing position shown in phantom lines. Piston 42 has an upper piston head 43, an elongated shaft 44 and a lower piston head 45. Piston heads 43 and 45 have an O-ring type seal 46 thereon for sealing engagement with the interior surface of manifold 41. The control valve 39 also includes an air inlet 49 to ambience and a coil spring 50 which abuts the lower piston head 45 and biases the piston to its air pressurizing position, and an opening 51 coupled to an outlet tube 53. The bottom of manifold 41 is vented to prevent the production of high pressure with downward movement of the piston.

Outlet tube 53 extends from manifold 41 to the inlet of pump 32. A pump outlet tube 55 extends from an outlet of pump 32 to a T-shaped connection 57. A tube 58 extends from the T-shaped connection 57 to a lower portion of control valve manifold 41 and continues from the manifold to pressure tank 19. Intake tube 36 is coupled to a check valve 60 which restricts the flow of fluids to storage tank 18. Outlet tube 53 is also coupled to a check valve 43 which restricts the flow of fluids from the pump 32 back to the control valve 39. Similarly, outlet tube 55 is coupled to a check valve 62 which restricts the flow of fluids back to pump 32. A flexible delivery tube 65 extends from the T-shaped connection 57 to nozzle 21. A pivotable trigger pinch bar 47 and a spring 48 are coupled to trigger 17. The spring 48 biases pinch bar 47 against delivery tube 65. A stop 49 is positioned against delivery tube 65 opposite pinch bar 47.

In use, the liquid storage tank 18 is filled with a liquid, hereinafter referred specifically to as water W, either by removing it from the stock 15 and filling it through neck 23 or by removing filling cap 25 and pouring water into the tank through opening 22. Should the storage tank be removed for filling it is subsequently threadably remounted to the stock.

The pump handle 33 is then reciprocally moved so as to actuate piston 34 through cylinder 35. The movement of the piston 34 within the cylinder 35 has two-cycle strokes, a priming stroke wherein fluid is drawn forth from the control valve, and a compression stroke wherein the fluid is displaced by the piston 34 and forced into the pressure tank. The priming stroke starts when the piston 34 is retreated within its cylinder 35 to create an elongated volume chamber 38. With the control valve piston in its air pressurizing position, the vacuum created by the expanding chamber 38 draws air into control valve air inlet 49, through the manifold 41 and through outlet tube 51 and into pump chamber 38. With the control valve piston 42 in its liquid pressurizing position, the vacuum created by the expanding chamber 38 draws water from the storage tank 18 through intake tube 36, manifold 41 and outlet tube 53 and into pump chamber 38. The flow of water into the expanding chamber 38 opens check valve 60 and 61 that are normally biased in closed positions. Removal of water from the storage tank creates a vacuum within the storage tank which is equalized by air passing through check valve 26.

The compression stroke created by the advancement of the piston 34 within the cylinder 35 causes the air or water within the chamber 38 to become pressurized. The pressure of the air or water opens check valve 62 that leads to the pressure tank 19. As the piston is reciprocated within its cylinder, air is repeatedly drawn from ambience or water is repeatedly drawn from the storage tank 18 and such deposited into the pressure tank 19.

The selection of water or air is determine by control valve 39. Initially, the pressure within pressure tank 19 is low and therefore the spring biased piston 42 of control valve 38 is positioned at its air pressurizing position. As such, the movement of pump handle 33 causes air to be drawn through air inlet 49 rather than overcoming the opening force needed to open check valve 60. This air then passes through the manifold 41, though pump 32 and into pressure tank 19. As the pressure within pressure tank 19 increases the pressure upon lower piston head 45 forces the piston 42 downwardly against the biasing force of spring 50. This continues to occur until a preselected pressure threshold is reached which corresponds to the piston upper head 43 moving past air inlet 49 to its liquid pressuring position, shown in phantom lines. The pump is now in fluid communication with only the storage reservoir and not with ambience. With continued actuation of the pump, the drawing force of the pump now opens check valve 60 and water is drawn though the manifold 41 and pump 32 and forced into pressure tank 19. This may occur until the force used to drive the piston can no longer overcome the stored pressures, or the water pressure reaches a preselected pressure level which overcomes the biasing force exerted by pinch bar 47 so as to allow the water to be released through delivery tube 65. The pressurized water is prevented from escaping the pressure tank through outlet tube 55 by check valve 62.

To release the pressurized water from the gun the trigger 17 is manually pulled to overcome the biasing force exerted by spring 48 upon pinch bar 47. Movement of pinch bar 47 from delivery tube 65 causes the pressurized water within tube 58, delivery tube 65 and pressure tank 19 to be released as a stream from nozzle 21. It should also be understood that the water gun may emit a stream of water while simultaneously pumping water through actuation of handle 33.

With the release of water from the pressure tank the pressure within the pressure tank will naturally decrease. Once again, the actuation of the pump will draw either water or air depending upon the pressure within the pressure tank and the consequential effect this pressure has on the control valve, i.e. the pressure within pressure tank 19 moves control valve piston 42 in determining whether water or air is to be drawn by pump 32. Thus, should the pressure within the pressure tank still be above the threshold level water will be pumped into the pressure tank. However, if the pressure is below the threshold level air will first be pump into the pressure tank followed by water upon reaching the threshold level. As such, the water within the pressure tank is kept near an optimal pressure through the selection of pumping water or air into the pressure tank for a given range of water levels.

Figure 3:
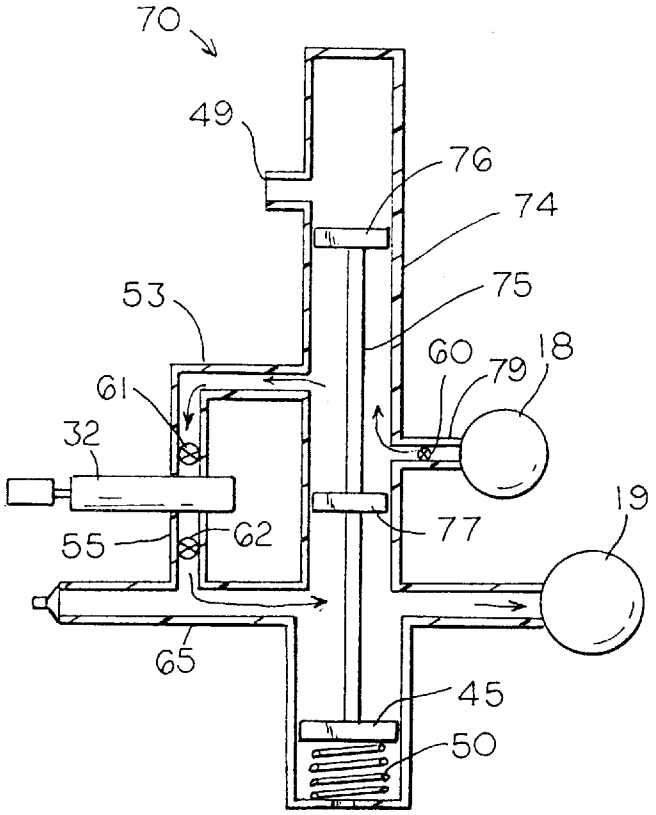
FIG. 3 is a schematic, cross-sectional view of the control valve of FIG. 2, shown in a position to force water into the pressure tank.
Figure 2:
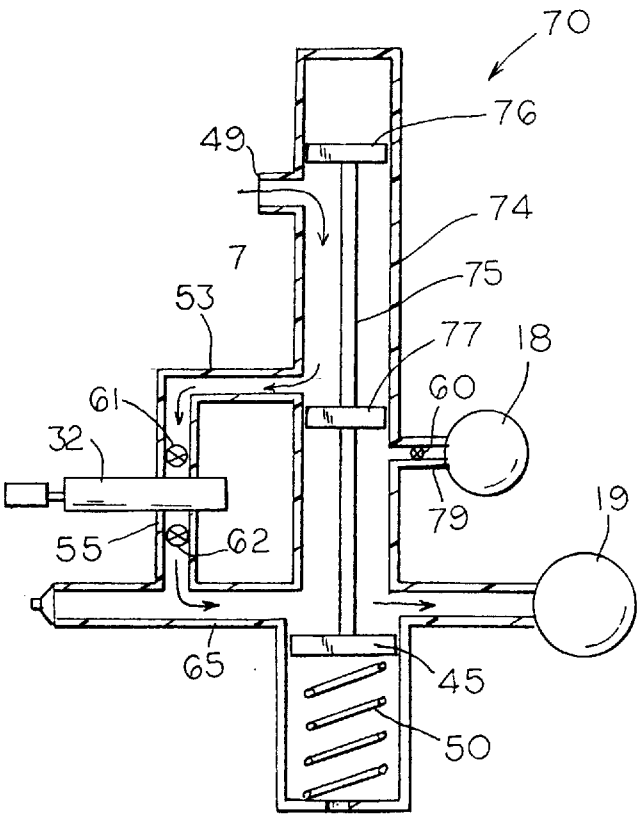
FIG. 2 is a schematic, cross-sectional view of an alternative embodiment of the control valve of the water gun shown in FIG. 1, shown in a position to force air into the pressure tank.

With reference next to FIGS. 2 and 3 there is shown a control valve 70 in an alternative embodiment. Here, the air inlet 49, the intake tube 36 and the outlet tube 53 are coupled to manifold 74 in another configuration. Also, piston 75 has an upper head 76 and a middle head 77 in addition to the previously described lower piston head 45. With this arrangement and the piston 75 in its air pressurizing position, as shown in FIG. 2, the upper head 76 is positioned above the air inlet 49 and the middle head 77 is positioned between the opening 78 of outlet tube 53 and the opening 79 of the intake tube 36 so that the pump is in fluid communication with ambience through air inlet 49. Thus, actuation of pump 32 draws air into the manifold 74 though air inlet 49 and out of the manifold through outlet tube 53 to pump 32 and subsequently to the pressure tank, i,e. air inlet 49 is in fluid communication with outlet tube 53. With increased pressure the piston is again moved against the biasing force of spring 50 to its liquid pressurizing position wherein the pump is in fluid communication with the storage reservoir, as shown in FIG. 3. The upper head 76 is now positioned between the air inlet 49 and the opening 78 for outlet tube 53 and the middle head 77 is positioned below intake tube opening 79. Thus, intake tube 36 is in fluid communication with outlet tube 53. The actuation of pump 32 draws water from the storage tank 18 through intake tube 36, manifold 74, outlet tube 53, pump 32 and tube 58 and forces it into the air pressurized pressure tank 19.

Figure 5:
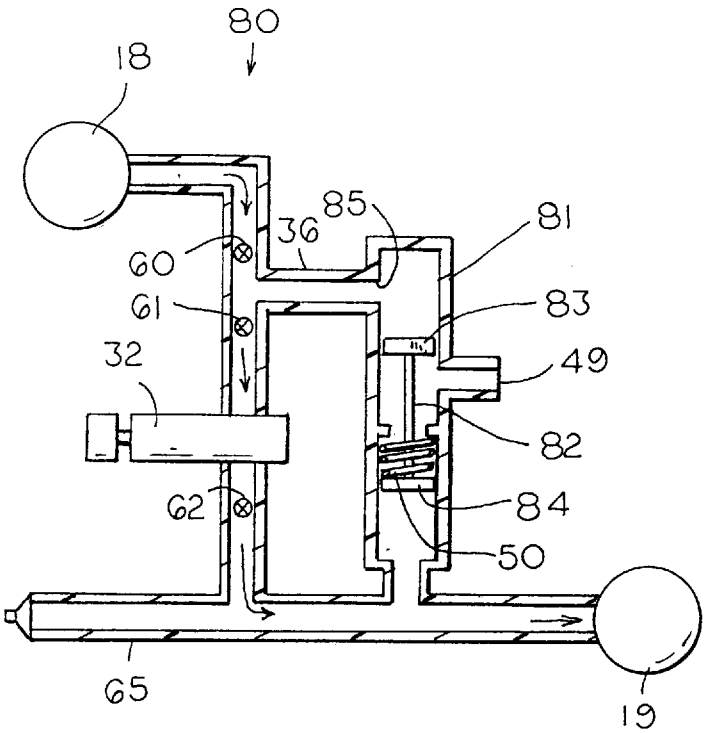
FIG. 5 is a schematic, cross-sectional view of the control valve of FIG. 4, shown in a position to force water into the pressure tank.
Figure 4:
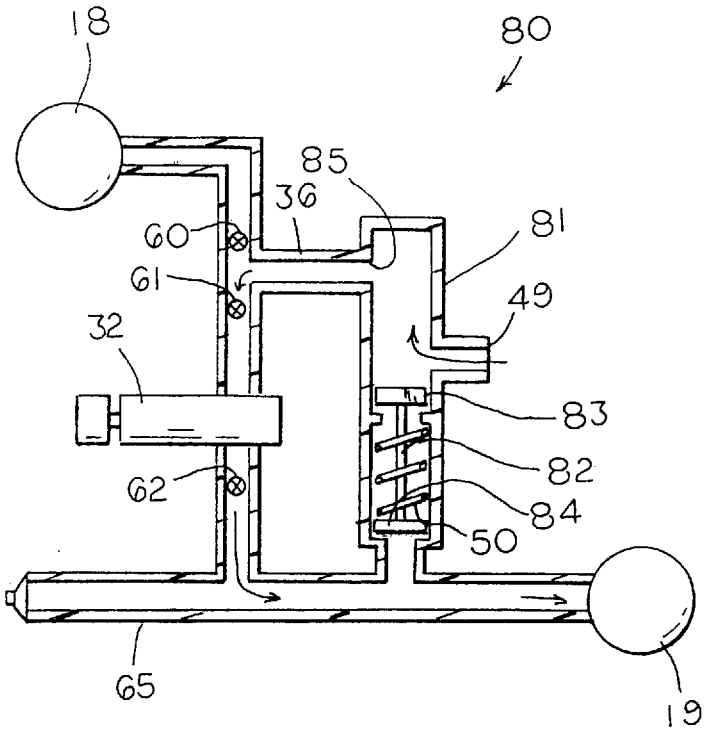
FIG. 4 is a schematic, cross-sectional view of another alternative embodiment of the control valve of the water gun shown in FIG. 1, shown in a position to force air into the pressure tank.

With reference next to FIGS. 4 and 5 there is shown a control valve 80 in another alternative embodiment. Here, the air inlet 49 and the intake tube 36 are coupled to the manifold 81 in another configuration. Intake tube 36 acts as both the previously described intake tube and outlet tube shown in FIG. 1. The control valve piston 82 has an upper head 83 and a lower head 84. With this arrangement and the piston 82 in its air pressurizing position, as shown in FIG. 4, the upper head 83 is positioned below the air inlet 49 so that the pump is in fluid communication with air inlet 49. Thus, actuation of pump 32 draws air into the manifold though air inlet 49 and out of the manifold through intake tube 36 to pump 32 and subsequently to the pressure tank, i,e. air inlet 49 is in fluid communication with intake tube 36. With increased pressure the piston is again moved against the biasing force of spring 50 to its liquid pressurizing position shown in FIG. 5. The upper head 83 is now positioned between the air inlet 49 and the opening 85 of intake tube 36 so that the pump is in fluid communication with the storage tank. The actuation of pump 32 draws water from the storage tank 18 through intake tube 36, manifold 81, intake tube 36, pump 32 and tube 58 and forces it into the air pressurized pressure tank 19.

It should be understood that these control valves may also be manually actuated rather than being automatically actuated by the pressure within the pressure tank. This may be done by simply extending a portion of the piston through the manifold in a position to be accessible to the user of the water gun and disassociating the control valve with the pressure tank. However, it is preferred that the control valve be automatically actuated by the stored pressures so that an optimal pressure and water level is achieved.

It thus is seen that a toy water gun in now provided which maintains a more constant pressure upon liquid while being dispensed from the pressure tank in a more efficient manner by controlling the pressure within the pressure tank through the selective introduction of water or air. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A toy water gun comprising:

a pump for drawing liquids and gases;

a storage reservoir adapted to hold liquid, said storage reservoir being in fluid communication with said pump;

a pressure tank adapted to hold liquid and gas, said pressure tank being in fluid communication with said pump;

control valve means for selectively controlling the drawing by said pump of gases from ambience or liquid from said storage tank and depositing the same into said pressure tank;

conduit means for conveying liquid from said pressure tank to ambience; and control means for controlling the flow of liquid through said conduit means, whereby the control valve means controls the pressure created by compressed air within the pressure tank by controlling whether the pump draws gases into the pressure tank for pressurization of liquid therein or liquids from the storage tank into the pressure tank.

2. The toy water gun of claim 1 wherein said control valve means is sensitive to pressure within said pressure tank whereby with the pressure within said pressure tank below a selected threshold level the control valve means directs gas into said pressure tank and upon the pressure within said pressure tank reaching said selected threshold the control valve means directs liquid from said storage reservoir into said pressure tank.

3. The toy water gun of claim 1 wherein said control valve means comprises a manifold having a first opening in fluid communication with ambience, a second opening in fluid communication with said storage reservoir, a third opening in fluid communication with said pump, and a movable piston mounted within said manifold for reciprocal movement therein, said piston being movable between a first position wherein said first opening is in fluid communication with said third opening and said second opening is not in fluid communication with said third opening and a second position wherein said first opening is not in fluid communication with said third opening and said second opening is in fluid communication with said third opening.

4. The toy water gun of claim 3 wherein said second opening is positioned between said first opening and said third opening, and wherein said piston has a seal positioned adjacent said first opening and distal said second opening with said piston in said first position and positioned between said first opening and said second opening with said piston in said second position.

5. The toy water gun of claim 3 wherein said third opening is positioned between said first opening and said second opening, and wherein said piston has a first seal and a second seal, wherein with said piston positioned in said first position said first seal is positioned adjacent said first opening distal said third opening and a second seal positioned between said third opening and said second opening, and with said piston in said second position said first seal is positioned between said first opening and said third opening and said second seal is positioned adjacent said second opening distal said third opening.

6. The toy water gun of claim 2 wherein said control valve comprises a manifold having a first opening in fluid communication with ambience, a second opening in fluid communication with said storage reservoir, a third opening in fluid communication with said pump, a movable piston mounted within said manifold for reciprocal movement therein, said piston being movable between a first position wherein said first opening is in fluid communication with said third opening and said second opening is not in fluid communication with said third opening and a second position wherein said first opening is not in fluid communication with said third opening and said second opening is in fluid communication with said third opening, spring biasing means for biasing said piston to said first position, a pressure chamber in fluid communication with said pressure tank, and wherein said piston has a head sealably mounted within said pressure chamber, whereby pressure within the pressure tank in fluid communication with the pressure chamber may bias the piston to the second position and against the biasing force of the spring biasing means.

7. The toy water gun of claim 6 wherein said second opening is positioned between said first opening and said third opening, and wherein said piston has a seal positioned adjacent said first opening and distal said second opening with said piston in said first position and positioned between said first opening and said second opening with said piston in said second position.

8. The toy water gun of claim 6 wherein said third opening is positioned between said first opening and said second opening, and wherein said piston has a first seal and a second seal, wherein with said piston positioned in said first position said first seal is positioned adjacent said first opening distal said third opening and said second seal is positioned between said third opening and said second opening, and with said piston in said second position said first seal is positioned between said first opening and said third opening and said second seal is positioned adjacent said second opening distal said third opening.

9. The toy water gun of claim 1 wherein said control valve means comprises a manifold having a first opening in fluid communication with ambience, a second opening in fluid communication with said storage reservoir, and a movable piston mounted within said manifold for reciprocal movement therein, said piston being movable between a first position wherein said first opening is in fluid communication with said second opening and a second position wherein said first opening is not in fluid communication with said second opening.

10. The toy water gun of claim 9 wherein said manifold further comprises a third opening in fluid communication with said pressure tank, and spring biasing means for biasing said piston to said first position wherein with said pressure tank in a low pressure condition said piston is spring biased to said first position and with said pressure tank in a high pressure condition the pressure therein overcomes the spring biasing force and said piston is moved by the pressure to said second position.

11. A toy water gun comprising:

a storage reservoir adapted to hold liquid;

a pressure tank adapted to hold liquid or gas or a combination thereof;

a pump adapted to pump liquids or gases;

conduit means for conveying liquid from said storage reservoir to said pump;

control valve means for selectively controlling the introduction of air into said pressure tank through the actuation of said pump or the introduction of liquid from said storage reservoir into said pressure tank through the actuation of said pump.

12. The toy water gun of claim 11 wherein said control valve means is sensitive to pressure within said pressure tank whereby with the pressure within said pressure tank below a selected threshold level the control valve means directs gas into said pressure tank and upon the pressure within said pressure tank reaching said selected threshold the control valve means directs liquid from said storage reservoir into said pressure tank.

13. The toy water gun of claim 11 wherein said control valve means comprises a manifold having an air intake opening in fluid communication with ambience, a liquid intake opening in fluid communication with said storage reservoir, an outlet in fluid communication with said pump, and a movable piston mounted within said manifold for reciprocal movement therein, said piston being movable between an air pressurizing position wherein said air intake opening is in fluid communication with said outlet and said liquid intake opening is not in fluid communication with said outlet and a liquid pressurizing position wherein said air intake opening is not in fluid communication with said outlet and said liquid intake opening is in fluid communication with said outlet.

14. The toy water gun of claim 13 wherein said liquid intake opening is positioned between said air intake opening and said outlet, and wherein said piston has a seal positioned adjacent said air intake opening and distal said liquid intake opening with said piston in said air pressurizing position and positioned between said air intake opening and said liquid intake opening with said piston in said liquid pressurizing position.

15. The toy water gun of claim 13 wherein said outlet is positioned between said air intake opening and said liquid intake opening, and wherein said piston has a first seal and a second seal, wherein with said piston positioned in said air pressurizing position said first seal is positioned adjacent said air intake opening distal said outlet and a second seal positioned between said outlet and said liquid intake opening, and with said piston in said liquid pressurizing position said first seal is positioned between said air intake opening and said outlet and said second seal is positioned adjacent said liquid intake opening distal said outlet.

16. The toy water gun of claim 12 wherein said control valve comprises a manifold having an air intake opening in fluid communication with ambience, a liquid intake opening in fluid communication with said storage reservoir, a outlet in fluid communication with said pump, a movable piston mounted within said manifold for reciprocal movement therein, said piston being movable between an air pressurizing position wherein said air intake opening is in fluid communication with said outlet and said liquid intake opening is not in fluid communication with said outlet and a liquid pressurizing position wherein said air intake opening is not in fluid communication with said outlet and said liquid intake opening is in fluid communication with said outlet, spring biasing means for biasing said piston to said air pressurizing position, a pressure chamber in fluid communication with said pressure tank, and wherein said piston has a head sealably mounted within said pressure chamber, whereby pressure within the pressure tank in fluid communication with the pressure chamber may bias the piston to the liquid pressurizing position and against the biasing force of the spring biasing means.

17. The toy water gun of claim 16 wherein said liquid intake opening is positioned between said air intake opening and said outlet, and wherein said piston has a seal positioned adjacent said air intake opening and distal said liquid intake opening with said piston in said air pressurizing position and positioned between said air intake opening and said liquid intake opening with said piston in said liquid pressurizing position.

18. The toy water gun of claim 16 wherein said outlet is positioned between said air intake opening and said liquid intake opening, and wherein said piston has a first seal and a second seal, wherein with said piston positioned in said air pressurizing position said first seal is positioned adjacent said air intake opening distal said outlet and said second seal is positioned between said outlet and said liquid intake opening, and with said piston in said liquid pressurizing position said first seal is positioned between said air intake opening and said outlet and said second seal is positioned adjacent said liquid intake opening distal said outlet.

19. The toy water gun of claim 11 wherein said control valve means comprises a manifold having an air intake opening in fluid communication with ambience, an outlet in fluid communication with said storage reservoir, and a movable piston mounted within said manifold for reciprocal movement therein, said piston being movable between an air pressurizing position wherein said air intake opening is in fluid communication with said outlet and a liquid pressurizing position wherein said air intake opening is not in fluid communication with said outlet.

20. The toy water gun of claim 19 wherein said manifold further comprises a pressure opening in fluid communication with said pressure tank, and spring biasing means for biasing said piston to said air pressurizing position wherein with said pressure tank in a low pressure condition said piston is spring biased to said air pressurizing position and with said pressure tank in a high pressure condition the pressure within said pressure tank overcomes the spring biasing force and said piston is moved to said liquid pressurizing position.

* * * * *